United States Patent [19]

Watine et al.

[11] 4,282,396

[45] Aug. 4, 1981

[54] HEAT-RECOVERABLE ARTICLES

[75] Inventors: Didier J. M. M. Watine, Maisons-Laffitte; Jean P. M. Hine, Courbevoie; Jean M. H. Catabelle, St. Cloud; Jean C. C. Delamotte, Franconville, all of France

[73] Assignee: Raychem Pontoise S.A., Saint Ouen L'Aumone, France

[21] Appl. No.: 41,387

[22] Filed: May 22, 1979

[30] Foreign Application Priority Data

Mar. 9, 1979 [GB] United Kingdom ..... 8459/79

[51] Int. Cl.[3] ..... H01R 4/02

[52] U.S. Cl. ..... 174/84 R; 174/DIG. 8

[58] Field of Search ..... 174/84 R, 78, DIG. 8

[56] References Cited

U.S. PATENT DOCUMENTS

| | | | |
|---|---|---|---|
| 3,200,190 | 8/1965 | Forney | 174/78 X |
| 3,305,625 | 2/1967 | Ellis | 174/84 R |

*Primary Examiner*—Roy N. Envall, Jr.

*Attorney, Agent, or Firm*—Lyon & Lyon

[57] ABSTRACT

The invention relates to an article suitable for making an electrical connection between two electrical conductors, for example an earth conductor and the outer conductor of a coaxial cable. The article comprises a heat-shrinkable sleeve and a quantity of solder which is positioned eccentrically within the sleeve and is held by and/or on the sleeve. The sleeve also comprises or has guide means capable of locating a portion of the earth conductor in proximity to the quantity of solder. On shrinking of the sleeve and fusing of the solder, an electrical connection can be made between an earth conductor received in the guide means and the outer conductor of a coaxial cable received in the sleeve.

59 Claims, 4 Drawing Figures

HEAT-RECOVERABLE ARTICLES

The present invention relates to a heat-recoverable article suitable, for example, for making an electrical connection between two electrical conductors and to a connection method using such an article.

Many articles and methods have been proposed for covering one or more substrates and/or for joining a plurality of substrates, for example for making an electrical connection between two electrically conductive substrates. Thus, for example, U.S. Pat. No. 3,243,211 discloses articles comprising a heat-shrinkable sleeve and a quantity of fusible material positioned within the sleeve. The fusible material may be, for example, a polymeric material or an inorganic fusible material, for example solder. An electrical connection between two conductors can be made, for example, by inserting the conductors in a sleeve which contains solder and heating the assembly to cause the sleeve to shrink and the solder to fuse.

A number of other specifications also describe articles which comprise a heat-shrinkable sleeve having a quantity of solder therein. Thus, for example, U.S. Pat. No. 3,324,230 describes an electrical connector which comprises a terminal pin (or similar electrical conductor) provided with a quantity of solder and having a heat-recoverable sleeve firmly installed thereon by shrinking one end of the sleeve into close contact with the pin. Moreover, U.S. Pat. No. 3,313,772 discloses a heat-shrinkable sleeve having a ring of solder therein and a ground lead (earth conductor) a portion of which is positioned between the solder ring and the sleeve.

While the articles referred to above have proved extremely useful in a wide variety of applications, they are not applicable in certain circumstances. Thus, for example, the connector described in U.S. Pat. No. 3,324,230 is designed to facilitate the connection of a further conductor to the terminal pin, and is not ideally suited to, for example, facilitating the connection of an earth conductor to the outer conductor (normally braid) of a coaxial cable. Furthermore, although the article referred to above and disclosed in U.S. Pat. No. 3,312,772 is designed for the latter use, there are circumstances in which its use can give rise to problems.

The present invention is concerned with the provision of an article comprising a heat-shrinkable sleeve containing solder, which is of use in making a connection between a first conductor, for example an earth conductor, and a second conductor, for example the outer conductor of a coaxial cable, and with the provision of a connection method using such an article.

The present invention provides an article which comprises a heat-shrinkable sleeve open at at least one end, and a quantity of solder positioned eccentrically within the sleeve and held by and/or on the sleeve, the solder being such that it does not extend round the entire inner circumference of any cross-section of the sleeve, the sleeve also comprising or having guide means capable of receiving and determining the radial location in the sleeve of an elongate substrate, the arrangement being such that when in use the elongate substrate is received in the guide means, a portion of the elongate substrate can be positioned in proximity to at least part of the quantity of solder.

The quantity of solder may, if desired or required, have an appropriate amount of flux associated therewith. In one embodiment of the invention, the solder is preferably not associated, in the article before installation on the conductors to be joined, with any electrically conductive member which is infusible at the temperature to which the article is heated to cause the heat-shrinkable sleeve to shrink and the solder (and flux if present) to fuse. The quantity of solder is advantageously actually in contact with the inner surface of the sleeve.

In a cross-section through the article of the invention in the region of the quantity of solder, the area of the solder is advantageously small relative to the total area enclosed by the sleeve and the same is preferably also true in a longitudinal section through the article in the region of the quantity of solder. Advantageously, in a cross-section through the article in the region of the solder the solder does not extend across the centre of the area enclosed by the sleeve and in such a cross-section the solder preferably does not protrude significantly into the area enclosed by the sleeve. Advantageously substantially all the solder is relatively close to the inner surface of the sleeve, and the quantity of solder is preferably positioned so as to permit the insertion into the article of an elongate article (for example the outer conductor of a coaxial cable) having dimensions only slightly smaller than those of the interior of the sleeve. Advantageously the circumferential extent of the solder in the sleeve is small relative to the inner circumference of the sleeve. The quantity of solder is advantageously localised at one or more portions of the inner circumference of the sleeve, that is in one or more segments of the sleeve. Preferably the solder is localised at one or more portions of the inner surface of the sleeve. Advantageously at least part of the solder is positioned in a projection of the outer circumference of the sleeve, which projection preferably substantially disappears on free recovery of the sleeve and fusing of the solder. The solder may if desired be partially enclosed by the material of the sleeve with part of the solder protruding, preferably to only a small extent, from the inner surface of the sleeve.

The quantity of solder may have any desired shape. In one advantageous embodiment of the invention, the quantity of solder is shaped and positioned such that when in use an elongate substrate (for example an earth conductor) is received in the sleeve and a portion of the elongate substrate is positioned in proximity to the quantity of solder, at least part of the solder is positioned between the said portion of the elongate substrate and the portion of the sleeve radially outwards of the said portion of the elongate substrate. In order to achieve this, at least part of the quantity of solder may, for example, be generally 'C'- or 'U'-shaped in cross-section, at least part of the exterior surface of the 'C' or 'U' advantageously being in contact with the inner surface of the sleeve.

The quantity of solder may comprise two parts spaced apart to permit the insertion of an elongate substrate, for example an earth conductor, between them. The two parts advantageously lie in a common cross-section of the sleeve and may be close to each other in the sleeve, but not quite touching, such that, for example, an elongate substrate of relatively small diameter may be positioned between them for connection to an elongate article of larger diameter which is also positioned within the sleeve. The configurations of the two parts may be such that the solder can retain the elongate substrate (for example an earth conductor) in a substantially fixed position in the sleeve and if each of the two parts is partially enclosed by the sleeve material (in which case part of the solder may be said to have sleeve material "wrapped" round it) with a part thereof protruding from the inner surface of the sleeve, the conductor may if desired be held in position by the projecting parts of the solder. The two parts may, for example, be opposed portions of a quantity of solder at least part of which is generally 'C' or 'U'-shaped in cross-section. Alternatively, for example, the two parts may be provided by two separate quantities of solder. Instead of being close to each other, two separate quantities of solder may be positioned substantially diametrically opposite each other in the sleeve, or may be otherwise spaced apart from each other. The or each quantity of solder may, if desired, be in the form of a ball.

The solder may be held by or on the sleeve in any desired manner. Advantageously, at least part of the solder is held in a projection of the outer circumference of the sleeve, which projection preferably substantially disappears on shrinking of the sleeve and fusing of the solder. Thus, for example, the sleeve may be provided with a receptacle for the solder by heating and deforming outwardly a portion of the sleeve and maintaining the deforming force while that portion of the sleeve cools. A receptacle formed in such a manner will, on heating, tend to recover its original shape and will thus tend to force solder contained therein towards the interior of the sleeve. Alternatively, for example, the quantity of solder may be positioned adjacent to the interior wall of a heat-shrinkable sleeve, the sleeve then being partially shrunk, under such conditions that the solder does not fuse, so that the interior wall partly surrounds the solder and the solder is firmly retained in the sleeve, complete recovery of the sleeve being prevented, where necessary, by mandrels.

In a further embodiment, the sleeve may comprise, for at least part of its length, two longitudinally extending compartments which are side-by-side to each other, one of the compartments (the small compartment) having a small cross-sectional area relative to the other (the large compartment). The quantity of solder, which in this embodiment is advantageously in the form of a ball, is retained in the small compartment, preferably being gripped by the inner walls of the small compartment. The compartments are, at least in the region of the solder and preferably throughout the length of the small compartment, in communication with each other. In use an elongate substrate, for example an earth conductor can be inserted in the small compartment whereby it is guided towards the solder, and on contact with the solder the end portion thereof may be deflected to a position in the large compartment in register with the solder, the solder thus acting both as a stop and as a means for guiding the substrate. If an elongate article is positioned in the large compartment and heat applied to cause the sleeve to shrink and the solder to fuse, at least part of the solder can flow into the large compartment to make a connection between the substrate and the article. An article wherein the sleeve comprises two longitudinally extending compartments may be made by any suitable method, for example by the use of a mandrel or by moulding.

It is, of course, also possible to use a sleeve which comprises two or more layers in which, for example, inner and outer layers cooperate to hold the solder, the arrangement being such that, on shrinking of the sleeve and fusing of the solder, the solder can, if it is not already in the desired location, be forced by the sleeve into that location. Where layers of a multi-layer sleeve cooperate to hold the solder, the solder may, if desired, also be held in a projection in the outer circumference of the sleeve, which projection advantageously substantially disappears on shrinking of the sleeve and fusing of the solder.

In one example of a sleeve comprising inner and outer layers which cooperate to hold the solder, or assist in holding the solder, the inner layer may extend for only part of the length of the outer layer, the solder, for example, a solder ball or solder wire, being positioned adjacent to an end, within the sleeve, of the inner layer such that part of the solder is sandwiched between the first inner and outer layers; during installation of such an article the inner and outer layers may cooperate to "squeeze" the solder into a desired location. In a second example of such a sleeve, the inner layer could extend for substantially the entire length of the outer layer, the solder being held between the layers in register with an aperture in the inner layer through which, in use, molten solder can be forced. A further example of an inner layer of the sleeve that could cooperate with an outer layer to hold the solder is an inner layer of open cross-section. Thus, for example, a resilient inner layer of substantially 'C'-shaped cross-section could be used, a quantity of solder being held between the two arms of the 'C'.

Of course the inner layer referred to above can be replaced by any other inner part of the sleeve that can hold the solder. Alternatively, for example, the solder could be stuck to the sleeve (and thus held on the sleeve) by, for example, sticky flux.

The sleeve in the article of the invention also comprises or has guide means capable of receiving and determining the radial location in the sleeve of an elongate substrate, the arrangement being such that when in use the elongate substrate is received in the guide means, a portion of the elongate substrate can be positioned in proximity to at least part of the quantity of solder. In this embodiment, therefore, the article of the invention comprises eccentrically positioned solder and guide means for locating a portion, preferably an end portion, of an elongate substrate (which may be, for example, a conductor for example an earth conductor) in proximity to the solder. Preferably at least a substantial part of the solder is positioned outside the guide means. In a cross-section through a preferred article according to the invention taken in the region of the guide means, a wall of the guide means may be said to divide the sleeve into two distinct compartments, although there may of course be an aperture in the wall such that the two compartments are in communication with each other for part or the whole of their length.

The guide means is preferably a channel open at both ends, although in some embodiments it may be open at only one end, and advantageously, at least part of the guide means is defined by a wall of the sleeve. Thus, for example, the guide means may be at least partly defined by a portion of an inner surface of the sleeve and a portion of a surface of an insert positioned within the sleeve.

In a preferred embodiment of the invention, the sleeve comprises a second outer layer and a second inner layer which extends for part only of the length of the outer layer and the guide means is at least partly defined by a portion of the inner surface of the said outer layer and a portion of the outer surface of the said inner layer. In this case, the sleeve can be said to comprise the guide means.

The guide means advantageously has a constriction therein for engaging an elongate substrate received in the guide means such that, although the substrate can be pushed past the constriction, accidental displacement of the substrate relative to the article may be substantially prevented. Where the guide means is at least partly defined by a wall of the sleeve, the constriction is advantageously formed by an indentation in the wall of the sleeve; if a multilayer sleeve is used, the indentation may if desired be in the wall of a layer forming part of the sleeve.

The article preferably also comprises a stop for limiting the axial penetration into the sleeve of an elongate substrate which in use is received in the guide means. The stop may, for example, be provided by a portion of the inner wall of the sleeve and/or by the quantity of solder. An appropriate shape may be imparted to the sleeve by partial preshrinkage of at least a portion of the sleeve over an appropriately shaped mandrel. The stop is preferably positioned such that, in a longitudinal section through the sleeve, it is spaced from the end of the guide means, the solder being positioned between, although not necessarily in axial alignment with, the stop and the said end of the guide means.

In a preferred embodiment, therefore, the invention provides an article comprising a heat-shrinkable sleeve having at least one open end. A quantity of solder is positioned eccentrically in the sleeve remote from the open end. A guide means, to guide an elongate substrate into a position where a portion of it is in proximity to the solder, is provided at least in the region of the sleeve between the open end and the solder and preferably, although the guide means and the solder may overlap, at least a portion of the solder is positioned further from the open end than is the guide means. It is not essential for the guide means to extend to the open end or to the solder. A stop, which determines the axial penetration of the elongate substrate into the sleeve, is preferably provided, the stop advantageously being positioned further from the open end than is the solder. The solder is so positioned that, on fusing of the solder, the elongate substrate can be electrically connected by the solder to an elongate article received in the sleeve but not in the guide means.

The heat-shrinkable sleeve used in accordance with the invention is a sleeve at least part of which will shrink on the application of heat and may comprise any material, advantageously an electrically insulating material, which may be converted to or maintained in a heat-shrinkable form. Examples of suitable materials are given in, for example, U.S. Pat. Nos. 3,086,242 and 3,297,819 and the other U.S. patents referred to in this specification. Crosslinked polymeric materials, for example crosslinked polyvinylidene fluoride, are particularly suitable. Where a sleeve comprising two or more layers is used, the inner layer(s) need not comprise the same material as the outer layer. The sleeve is advantageously sufficiently transparent to enable the soldered connection made therein to be inspected.

The sleeve may be extruded as such, or may be formed from a sheet of material (which may if desired be heat-shrinkable) opposite edges of the sheet being joined in any suitable manner, for example by the use of a peroxide, by use of a contact adhesive (for example as disclosed in U.S. Pat. No. 3,770,556), or by the use of an insert comprising a thermoplastic material and a heat-activatable crosslinking agent (see for example U.S. Pat. Nos. 3,891,490 and 3,927,233 and British patent specification No. 1,512,727) to form the sleeve. If desired, the opposite edges of the sheet may be provided with means for making a connection between them (see for example U.S. Pat. Nos. 3,455,336, 3,379,218, 3,530,898 and 3,574,313). Where the sleeve is formed from a sheet of material, the sheet may if desired be shaped to hold the quantity of solder before formation of the sleeve. Heat-shrinkability may, if necessary, be imparted to a sleeve by any suitable method.

Where the sleeve comprises a plurality of layers an adhesive material may, if desired, be positioned (for example in the form of a continuous or discontinuous layer) between the layers. The presence of an adhesive is not, however, essential. If the sleeve comprises inner and outer layers, the inner layer is preferably substantially infusible at the temperature to which in use the article is heated to cause the sleeve to shrink and the solder to fuse and advantageously both the inner and outer layers are heat-shrinkable. If desired, however, the inner layer may be fusible at the temperature to which in use the article is heated to cause shrinking of the sleeve and fusing of the solder, and in one embodiment, a fusible inner layer may be formed integrally with a quantity of fusible material which is positioned between the guide means and an end of the sleeve, the fusible material extending round the entire inner circumference of a cross-section of the sleeve and being in abutting relationship to the inner surface of the outer layer. Except in the region of the guide means the outer surface of the inner layer preferably contacts the inner surface of the outer layer and/or a further layer, which may be continuous or discontinuous, on the said inner surface. If desired, the second outer layer may be integral with the first outer layer, if present, and/or the second inner layer may be integral with the first inner layer if present; thus a single outer layer and single inner layer may, if desired, act both to hold, or assist in holding, the solder and to provide the guide means.

The heat-shrinkable sleeve may have any desired shape. One method by which a desired shape may be imparted comprises partial recovery of the sleeve round one or more appropriately-shaped mandrels. In one preferred embodiment of the invention, at least a portion of the sleeve is resiliently deformable in cross-section and has a inner surface of a different shape from the outer surface of an elongate article on which the article is to be installed such that on deformation the sleeve will readily receive the elongate article and, on release of the deforming force, will grip the said article. Where the elongate article is a cable of substantially circular cross-section, the interior of the said portion of the sleeve is advantageously of non-circular cross-section and preferably has two long sides and two short sides, which sides are not necessarily straight. Advantageously the said portion of the sleeve is substantially rectangular in cross-section; in this embodiment, the solder may, if desired, be associated with one or both of the shorter sides of the rectangle. During installation, slight pressure may be applied to the sides of such a sleeve of non-circular or other appropriate cross-section to impart an appropriate cross-section to the sleeve, the pressure being released after insertion of for example a cable in the sleeve so that sides of the sleeve grip the cable in position.

The sleeve may be open at one or both ends and may if desired be provided with a quantity of fusible material (for example fusible polymeric material) or other sealing material between the solder and the or each open end. Where the sleeve contains a fusible insert, this may provide the quantity of fusible material. The fusible material may act as a "dam" for the solder, preventing it from flowing out of the open end(s) of the sleeve during installation of the article and/or may enhance the environmental seal at the end(s) of the sleeve. Thus, the sleeve may force fused fusible material into close contact with a conductor received in the open end of the sleeve to provide a reliable seal. Alternatively, if an appropriate quantity of fusible material is provided, the sleeve and the fused fusible material could cooperate to produce a seal even at an open end that does not in use receive a substrate. Where the sleeve has a quantity of fusible material or one or more other inserts therein, the fusible material or other insert may be fixed in the sleeve in any appropriate manner, for example by partial recovery of the sleeve over the insert(s) to make the latter a tight fit.

The invention also provides a method of electrically connecting first and second electrical conductors which comprises in either order or substantially simultaneously positioning the first conductor such that it is received in the guide means of an article according to the invention with a portion of the first conductor in proximity to the solder and positioning the second conductor in the sleeve, and then heating to cause shrinkage of the sleeve and flowing of the solder whereby an electrical connection is made between the conductors. Advantageously the said portion of the first conductor is an end portion.

When the quantity of solder comprises two parts spaced apart from each other, the first conductor is advantageously positioned between, and may if desired contact and be retained in position by, the two parts. The two parts may if desired act as positioning means for the first conductor. The first conductor may be, for example, an earth conductor and the second conductor, may be, for example, the braid of a coaxial cable.

Articles constructed according to the invention may readily be manufactured without the use of complicated tooling. Furthermore, as the solder is positioned eccentrically within the sleeve and is held by and/or on the sleeve, substrates to be connected may be inserted into the sleeve such that they are in proximity to the solder and, on heating, the sleeve can force the molten solder directly radially inwardly into contact with at least one and preferably both of the substrates. Where the solder comprises two parts adjacent to each other, the solder may also act as additional positioning means and, optionally, retaining means for one of the substrates.

Articles constructed in accordance with the invention, which comprise eccentrically positioned solder, may be used to provide a localised soldered joint. Thus, solder may be provided at the location(s) where it is desired to form a connection without the use of excess solder which may after fusing be present in undesired locations; for example, where an earth conductor is connected to the outer conductor of a coaxial cable, the use of the article of the invention may result in there being substantially equal amounts of solder on the earth conductor and on the outer conductor in the final assembly. Furthermore, because it is necessary to fuse only the amount of solder which is required to form the joint, a smaller amount of heat is required, thus lessening the risk of overheating, for example, the sleeve, which in turn may make it possible, if desired, to use solder of a higher melting point than would be possible if for example a complete ring of solder were used.

As the article of the invention comprises not only localised solder, but also guide means for positioning an elongate substrate, for example an earth conductor, in the correct position relative to the solder, it is particularly easy to ensure, especially when the article also comprises a stop for limiting the axial movement of the elongate substrate, that a substrate will be located in the most advantageous position for efficient soldering. Furthermore, after shrinking of the sleeve, the guide means (particularly where the latter is formed between inner and outer heat-shrinkable layers of the sleeve) may act to grip the elongate substrate, for example the earth conductor, firmly in position and provide strain relief. Where the sleeve comprises more than one layer of material (in order, for example, to define the guide means and/or to hold the solder), the inner layer may act to give additional protection to, for example, cable insulation having a low temperature rating which might otherwise be adversely affected by the heat applied to cause skrinkage of the sleeve.

As indicated earlier, at least part of the sleeve itself may be shaped to grip an elongate article for example a cable, to which a connection is to be made. At least part of such a sleeve may be such that it can be deformed during installation and, on release of the deforming forces, will grip the cable or other article. The fact that the sleeve does grip the elongate article may ensure that the sleeve is maintained in a preferred orientation in relation to the elongate article (and is preferably also so maintained during heat-recovery of the sleeve) and/or may provide means for ensuring that, for example, a further article or member is in the correct position relative to the elongate article and/or to an insert within the sleeve. Thus, for example, in the case of the article of the invention wherein at least part of the sleeve has a substantially rectangular cross-section, the fact that the sleeve may, before (and preferably also during) recovery, grip an elongate article positioned in it makes it possible, if this is desired, to ensure that the solder is in a preferred orientation relative to the elongate article. Moreover, portions of the sleeve that, before recovery, are spaced from the elongate article may, in cooperation with the outer surface of the elongate article, define one or more compartments for locating a further substrate in a desired position, for example in relation to the elongate article and/or in relation to the solder. The fact that the sleeve and elongate article contact each other where the sleeve grips the cable may also, if the solder is appropriately positioned, assist in maintaining molten solder in a desired location during recovery of the article.

The situation described above in connection with articles comprising solder positioned eccentrically within a heat-shrinkable sleeve is in contrast to the situation in the case of, for example a device as disclosed in U.S. Pat. No. 3,312,772 which contains a complete ring of solder. In the case of such a device it has now been found that a relatively large ring of solder and hence a relatively thick sleeve is in practice required if sufficient solder is to be present at the desired location (i.e. at the point where the connection is to be made between the earth conductor and the outer conductor), so that a considerable quantity of heat must be applied to ensure complete shrinking of the sleeve and fusing of the solder, with the attendant possibility of overheating. It has also now been found that the ring of solder in U.S.

Pat. No. 3,312,772 provides much more solder than is needed to connect the earth conductor with the outer conductor. This is disadvantageous, not only because it wastes solder, but also because solder may reach locations in the completed connection where it should not be.

Various embodiments of the invention will now be described in greater detail, by way of example only, with reference to the accompanying drawings, in which.

Figure 1:
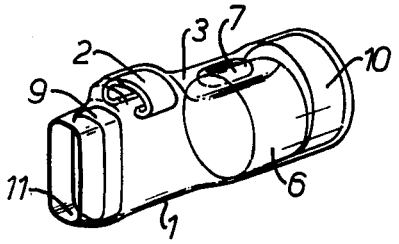
FIG. 1 is a perspective view of one embodiment of the invention.
Figure 2:
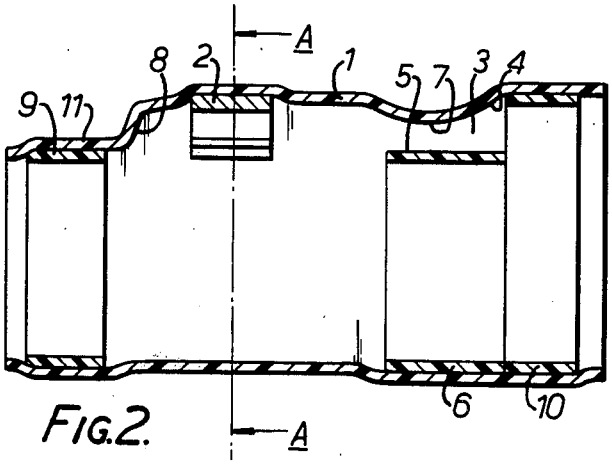
FIG. 2 is an enlarged longitudinal section through the article of FIG. 1.
Figure 3:
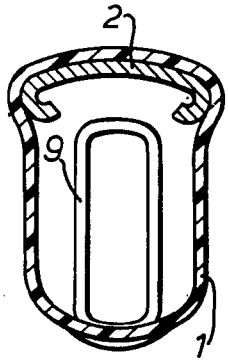
FIG. 3 is a cross-section taken on the line A—A in FIG. 2.

Referring now to the drawings, the article shown in FIGS. 1 to 3 comprises a heat-shrinkable sleeve 1 having positioned eccentrically within it a strip 2 of solder (and if desired flux) which is generally 'C'-shaped in cross-section. The outer surface of the 'C' is firmly engaged by a portion of the inner surface of the sleeve 1, the said portion having previously been partially shrunk into close contact with the solder strip 2; in this embodiment therefore, the solder is held solely by the sleeve 1.

The article of FIGS. 1 to 3 also comprises a guide channel 3 capable of receiving and locating, for example, an earth conductor whereby the end of the earth conductor may be positioned in proximity to, and in the direction of recovery of, the solder strip 2. The guide channel is defined by the inner surface 4 of the sleeve 1 and the outer surface 5 of an inner sleeve 6 positioned within the sleeve 1, the sleeve 1 can be said to form the outer layer and the sleeve 6 the inner layer of a multi-layer sleeve. Except in the region of the guide channel 3, the inner sleeve 6 is in contact with the outer sleeve 1. The guide channel 3 has a constriction therein formed by an indentation 7 in the sleeve 1 for gripping, for example, the insulation of an earth conductor received in the guide channel 3.

As can be seen from the drawings, when an elongate substrate, for example an earth conductor (not shown in the drawings) is received in the guide channel 3 the end portion of the substrate may be positioned between the "arms" of the 'C'-shaped solder strip; the sleeve 1 is shaped such that a portion 8 of its inner surface provides a stop to limit the axial penetration of for example the earth conductor into the sleeve. When an earth conductor is positioned in this way and heat is applied to cause the sleeve 1 to shrink and the solder to fuse, molten solder is forced radially inwards by the sleeve into contact with the end portion of the earth conductor and into contact with a second substrate (for example the braid of a coaxial cable) which may previously have been introduced into the sleeve.

A ring (or layer), 9 and 10 respectively, of fusible polymeric material is provided in the region of each end of the sleeve 1, the ring 10 being positioned between the guide means and the open end adjacent thereto. The polymeric material may, after installation of the sleeve, provide a seal to the substrate(s) positioned in the sleeve. One end portion 11 of the sleeve 1 (and the associated fusible layer 9) is generally rectangular in cross-section to enable that end portion to grip a substrate, for example a cable; on which the article is mounted so that the article may be reliably retained in the desired position during the heating step.

Figure 4:
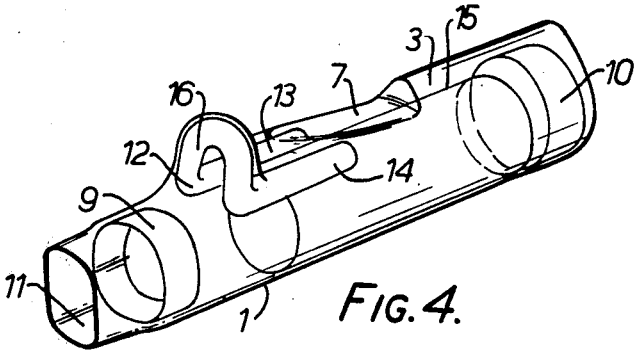
FIG. 4 is a perspective view of another embodiment of the invention.

The article shown in FIG. 4 differs from that shown in FIGS. 1 to 3 primarily in the form of the quantity of solder and the manner in which this is retained in the sleeve 1. The solder in the article shown in FIG. 4 is in the form of a wire 12 of substantially circular cross-section, each of the end portions 13 and 14 of the wire extending in an axial direction and being held by cooperation between the inner surface of the sleeve 31 and the outer surface of a sleeve 15 positioned within the sleeve 1; the sleeve 1 can be said to form the outer layer and the sleeve 15 the inner layer of a multi-layer sleeve. The centre portion 16 of the solder wire 12 lies in a plane which is substantially perpendicular to the plane containing the end portions 13 and 14 of the wire and is so shaped that in a cross-section through the article which contains the centre portion the solder is generally U-shaped, with the curved portion of the U in contact with the interior of the sleeve 1. The sleeve 1 is partially preshrunk around the centre portion 16 of the wire to assist in maintaining the wire in the desired position in the sleeve. In the article of FIG. 4, the sleeve 15 acts both to hold the solder and, together with the sleeve 1, to define the guide channel for, for example, the earth conductor.

In a modification (not shown) of the article shown in FIG. 4, the centre portion of the solder wire may lie in the same plane as the end portions of the wire. In this embodiment, the centre portion of the wire may act as an axial stop for the first substrate.

It will be noted that in all the figures at least part of the solder is positioned in a projection in the outer circumference of the sleeve. In the case of the sleeves shown in the drawings the said projection will substantially disappear, or become less pronounced, on free recovery of the sleeve and fusing of the solder.

We claim:

1. An article which comprises a heat-shrinkable sleeve open at at least one end, and a quantity of solder positioned eccentrically within the sleeve and held by the sleeve, the solder being such that it does not extend round the entire inner circumference of any cross-section of the sleeve, the sleeve also having guide means for receiving and determining the radial location in the sleeve of an elongate substrate, the arrangement being such that when in use the elongate substrate is received in the guide means, a portion of the elongate substrate can be positioned in proximity to at least part of the quantity of solder.

2. An article which comprises a heat-shrinkable sleeve open at at least one end, and a quantity of solder positioned eccentrically within the sleeve and held on the sleeve, the solder being such that it does not extend round the entire inner circumference of any cross-section of the sleeve, the sleeve also having guide means for receiving and determining the radial location in the sleeve of an elongate substrate, the arrangement being such that when in use the elongate substrate is received in the guide means, a portion of the elongate substrate can be positioned in proximity to at least part of the quantity of solder.

3. An article as claimed in claim 1 or 2, wherein in a cross-section through the article in the region of the quantity of solder, the area of the solder is small relative to the total area enclosed by the sleeve.

4. An article as claimed in claim 1 or 2, wherein in a cross-section through the article in the region of the quantity of solder the solder does not protrude significantly into the area enclosed by the sleeve.

5. An article as claimed in claim 1 or 2, wherein the quantity of solder is positioned so as to permit insertion in the sleeve of an elongate article having dimensions only slightly smaller than those of the interior of the sleeve.

6. An article as claimed in claim 1 or 2, wherein the quantity of solder is localised at at least one portion of the inner surface of the sleeve.

7. An article as claimed in claim 1 or 2, wherein the quantity of solder comprises two parts spaced apart from each other such that when in use the elongate substrate is received in the guide means a portion of the elongate substrate can be positioned between the two parts.

8. An article as claimed in claim 7, wherein the two parts lie in a common cross-section of the sleeve.

9. An article as claimed in claim 7, wherein the two parts are close to, but do not touch, each other.

10. An article as claimed in claim 7, wherein the two parts are opposed portions of a quantity of solder at least part of which is generally 'C'-shaped in cross-section.

11. An article as claimed in claim 1 or 2, wherein at least part of the quantity of solder is generally 'C'-shaped in cross-section.

12. An article as claimed in claim 11, wherein at least part of the exterior surface of the 'C' or 'U' is in contact with the inner surface of the sleeve.

13. An article as claimed in claim 1 or 2, wherein the quantity of solder is localised at one portion of the inner surface of the sleeve, is generally 'C'-shaped in cross-section, and is held solely by the sleeve.

14. An article as claimed in claim 1 or 2, wherein at least part of the solder is positioned in a projection of the outer circumference of the sleeve.

15. An article as claimed in claim 14, wherein the projection substantially disappears on free recovery of the sleeve and fusing of the solder.

16. An article as claimed in claim 1, wherein the quantity of solder is held in position in the sleeve by a partially shrunk portion of the sleeve.

17. An article as claimed in claim 1 or 2, wherein the quantity of solder is partially enclosed by the material of the sleeve.

18. An article as claimed in claim 1, wherein the sleeve comprises a plurality of layers which cooperate to hold the solder.

19. An article as claimed in claim 18, wherein the sleeve comprises a first outer layer and a first inner layer which extends for part only of the length of the first outer layer, the solder being held by cooperation between an end portion of the first inner layer and the portion of the first outer layer adjacent to said end portion of the first inner layer.

20. An article as claimed in claim 19, wherein the quantity of solder comprises at least one portion which extends longitudinally in the sleeve and is sandwiched between the first inner layer and the first outer layer and at least one portion which is not positioned between said layers.

21. An article as claimed in claim 7, wherein the two parts are opposed portions of a quantity of solder at least part of which is generally 'U'-shaped in cross-section.

22. An article as claimed in claim 1 or 2, wherein at least part of the quantity of solder is generally 'U'-shaped in cross-section.

23. An article as claimed in claim 22, wherein at least part of the exterior surface of the 'U' is in contact with the inner surface of the sleeve.

24. An article which comprises a heat-shrinkable sleeve open at at least one end, and a quantity of solder positioned eccentrically within the sleeve and held by the sleeve, the solder being such that it does not extend round the entire inner circumference of any cross-section of the sleeve, the quantity of solder being positioned remote from the open end of the sleeve, and a guide means, to receive an elongate substrate and to guide it into a position wherein a portion thereof is in proximity to the solder, the guide means being provided at least in the region between the open end and the solder.

25. An article as claimed in claim 1 or 2, wherein at least a substantial part of the solder is positioned outside the guide means.

26. An article as claimed in claim 1 or 2, wherein at least a portion of the solder is positioned further from the open end of the sleeve than is the guide means.

27. An article as claimed in claim 1 or 2, wherein the quantity of solder is positioned such that when in use the elongate substrate is received in the guide means and a portion of the elongate substrate is positioned in proximity to the quantity of solder at least part of the solder is positioned between said portion of the first substrate and the portion of the sleeve radially outwards of the said portion of the first substrate.

28. An article as claimed in claim 1 or 2, wherein the guide means comprises a channel having two open ends.

29. An article as claimed in claim 1 or 2, wherein at least part of the guide means is defined by a wall of the sleeve.

30. An article as claimed in claim 1 or 2, wherein the guide means is at least partly defined by a portion of the inner surface of the sleeve and at least part of a surface of an insert positioned within the sleeve.

31. An article as claimed in claim 1 or 2, wherein the sleeve comprises a second outer layer and a second inner layer which extends for part only of the length of the second outer layer and wherein the guide means is at least partly defined by a portion of the inner surface of the second outer layer and a portion of the outer surface of the second inner layer.

32. An article as claimed in claim 31, wherein, except in the region of the guide means, the outer surface of the second inner layer contacts the inner surface of the second outer layer.

33. An article as claimed in claim 31, wherein at least part of the second inner layer is fusible at the temperature to which in use the article is heated to cause shrinking of the heat-shrinkable sleeve and fusing of the solder.

34. An article as claimed in claim 33, wherein the second inner layer is formed integrally with a quantity of fusible material which is positioned between the guide means and an end of the sleeve, the fusible material extending round the entire inner circumference of a cross-section of the sleeve and being in abutting relationship to the inner surface of the second outer layer.

35. An article as claimed in claim 31, wherein the sleeve comprises first inner and outer layers and wherein a single outer layer provides both the first outer layer and the second outer layer.

36. An article as claimed in claim 31, wherein the sleeve comprises first inner and outer layers and wherein a single inner layer provides both the first inner layer and the second inner layer.

37. An article as claimed in claim 1 or 2, wherein the guide means has a constriction therein for engaging an elongate substrate received, in use, in the guide means.

38. An article as claimed in claim 37, wherein the constriction is formed by an indentation in the wall of the sleeve.

39. An article as claimed in claim 1 or 2, which also comprises a stop for limiting the axial penetration into the sleeve of an elongate substrate which in use is received in the guide means.

40. An article as claimed in claim 39, wherein the stop comprises a portion of the interior wall of the sleeve.

41. An article as claimed in claim 39, wherein the stop comprises the quantity of solder.

42. An article as claimed in claim 19, wherein both the inner and outer layers are heat-shrinkable.

43. An article as claimed in claim 1 or 2, wherein at least a portion of the sleeve is resiliently deformable in cross-section and is of non-circular internal cross-section.

44. An article as claimed in claim 43, wherein the resiliently deformable portion of the sleeve has two long sides and two short sides.

45. An article as claimed in claim 43, wherein the resiliently deformable portion of the sleeve is substantially rectangular in cross-section.

46. An article as claimed in claim 45, wherein the or each quantity of solder is adjacent to a short side of the rectangle.

47. An article as claimed in claim 1 or 2, wherein the sleeve is open at both ends.

48. An article as claimed in claim 1 or 2, wherein the sleeve comprises electrically insulating material.

49. An article as claimed in claim 1 or 2, wherein a quantity of fusible material is positioned between the solder and each open end of the sleeve.

50. An article as claimed in claim 31, wherein, except in the region of the guide means, the outer surface of the second inner layer contacts the inner surface of the second outer layer and a further layer on said inner surface.

51. An article as claimed in claim 31, wherein, except in the region of the guide means, the outer surface of the second inner layer contacts a further layer on the inner surface of the second outer layer.

52. An article as claimed in claim 31, wherein both the inner and outer layers are heat-shrinkable.

53. An article which comprises a heat-shrinkable sleeve open at at least one end, and a quantity of solder positioned eccentrically within the sleeve and held on the sleeve, the solder being such that it does not extend round the entire inner circumference of any cross-section of the sleeve, the quantity of solder being positioned remote from the open end of the sleeve, and a guide means to receive an elongate substrate and to guide it into a position wherein a portion thereof is in proximity to the solder, the guide means being provided at least in the region between the open end and the solder.

54. A method of connecting first and second electrical conductors which comprises (a) selecting an article which comprises a heat-shrinkable sleeve open at least one end, and a quantity of solder positioned eccentrically within the sleeve and held by the sleeve, the solder being such that it does not extend round the entire inner circumference of any cross-section of the sleeve, the sleeve also having guide means for receiving and determining the radial location in the sleeve of an elongate substrate, the arrangement being such that when in use the elongate substrate is received in the guide means, a portion of the elongate substrate can be positioned in proximity to at least part of the quantity of solder; (b) subsequently, in either order or substantially simultaneously, positioning the first conductor such that it is received in the guide means of the selected article with a portion of the first conductor in proximity with the solder and positioning the second conductor in the sleeve; and then (c) heating to cause shrinkage of the sleeve and flowing of the solder whereby an electrical connection is made between the conductors.

55. A method of connecting first and second electrical conductors which comprises (a) selecting an article which comprises a heat-shrinkable sleeve open at at least one end, and a quantity of solder positioned eccentrically within the sleeve and held on the sleeve, the solder being such that it does not extend round the entire inner curcumference of any cross-section of the sleeve, the sleeve also having guide means for receiving and determing the radial location in the sleeve of an elongate substrate, the arrangement being such that when in use the elongate substrate is received in the guide means, a portion of the elongate substrate can be positioned in proximity to at least part of the quantity of solder; (b) subsequently, in either order or substantially simultaneously, positioning the first conductor such that it is received in the guide means of the selected article with a portion of the first conductor in proximity with the solder and positioning the second conductor in the sleeve; and then (c) heating to cause shrinkage of the sleeve and flowing of the solder whereby an electrical connection is made between the conductors.

56. A method as claimed in claim 54 or 55, wherein the portion of the first conductor is an end portion.

57. A method as claimed in claim 54 or 55, wherein the quantity of solder comprises two parts spaced apart from each other and wherein the first conductor is positioned between the two parts.

58. A method as claimed in claim 54 or 55, wherein the article comprises a stop for limiting the axial penetration of the first conductor into the sleeve and wherein the first conductor is positioned in the sleeve such that a portion of the first conductor abuts the stop.

59. A method as claimed in claim 54 or 55, wherein the first conductor is an earth conductor and the second conductor is the outer conductor of a coaxial cable.

* * * * *